United States Patent [19]

Dawdy et al.

[11] 3,987,595

[45] Oct. 26, 1976

[54] REMOVABLE WALLBOARD TIE

[75] Inventors: Jack A. Dawdy, Kenmore; Rodney G. Buergin, Snyder, both of N.Y.

[73] Assignee: National Gypsum Company, Buffalo, N.Y.

[22] Filed: June 11, 1975

[21] Appl. No.: 585,972

[52] U.S. Cl. ..... 52/127; 52/363; 52/417; 156/71

[51] Int. Cl.[2] ..... E04B 2/00

[58] Field of Search ..... 52/127, 417, 363, 366, 52/344, 354, 418, 368; 156/71

[56] References Cited

UNITED STATES PATENTS 3,300,933 1/1967 Donahue ..... 52/417 X

FOREIGN PATENTS OR APPLICATIONS 90,894 10/1921 Switzerland ..... 52/363

*Primary Examiner*—J. Karl Bell

*Attorney, Agent, or Firm*—Robert F. Hause

[57] ABSTRACT

Two adjacent sheets of wallboard are held firmly against a stud, until the adhesive between the wallboard and the stud becomes firm, by a tie wire which is removably held by two spaced apart staples in the stud, and by an elongate rigid block which is held against the face of the wallboards by tie wire.

10 Claims, 6 Drawing Figures

REMOVABLE WALLBOARD TIE

This invention relates to a novel temporary tie means for holding wallboard against a stud, and particularly to the use of a pair of staples with a tie wire, whereby the wire can be subsequently removed without removal of the wallboards.

Predecorated gypsum wallboard is commonly applied to studs or other structural framing members by use of an adhesive, rather than damaging the predecorated face with nails or screws. In adhesive application of wallboard, it is necessary to provide some secondary temporary means for holding the board to the stud until the adhesive dries or sets or in some manner becomes firm.

In accordance with the present invention, a tie wire is stapled to the face of a stud by two spaced apart staples, and the two end portions of this tie wire are bent to extend through the joint between two coplanar adjacent wallboards. These two tie wire end portions are then tied, or otherwise affixed, to means for urging the wallboard edges firmly against the stud, with the adhesive disposed therebetween. A day or two later, depending on the adhesive, one of the two tie wire end portions is cut, releasing the means to which the wire was affixed. The other of the two tie wire end portions is then pulled, causing the inner part of the cut end to be pulled through the two staples, and the wire can then be completely removed.

It is an object of the invention to provide an improved combination for temporarily holding wallboard to studs while an adhesive sets.

It is a further object to provide a novel method of affixing wallboard edges to wall studs.

These and other objects and advantages of the present invention will be more fully apparent when considered in relation to the preferred embodiments thereof as set forth in the specification and as shown in the drawings in which.

Figure 1:
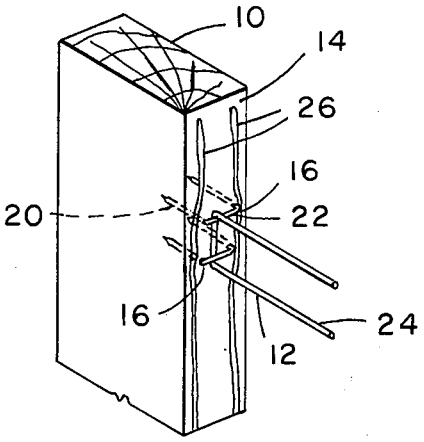
FIG. 1 is an isometric view of a portion of a stud with a tie wire stapled thereto, in accordance with the invention.
Figure 2:
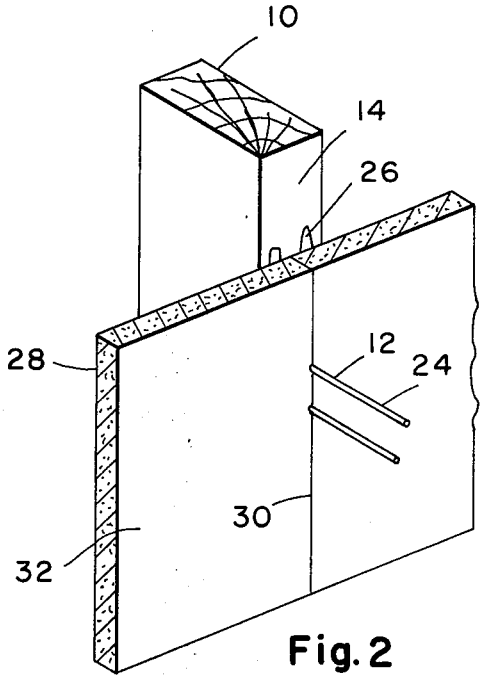
FIG. 2 is a view of the stud of FIG. 1 with wallboards applied thereto.
Figure 3:
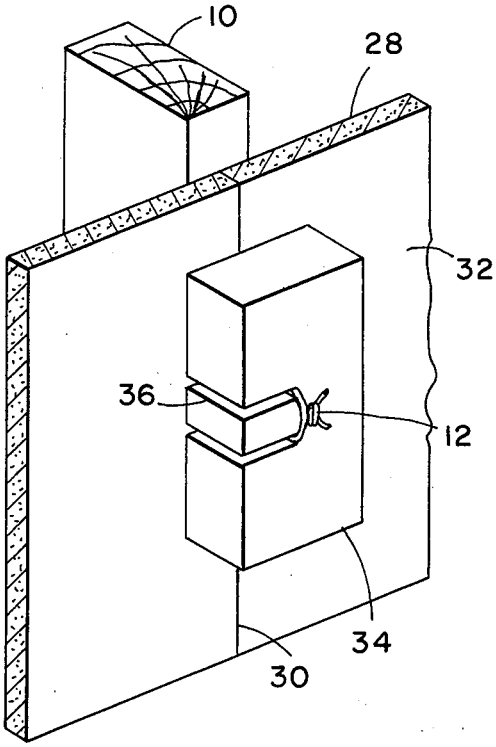
FIG. 3 is a view of the stud and wallboards of FIG. 2 with the temporary wallboard holding means in place, in accordance with the invention.
Figure 5:
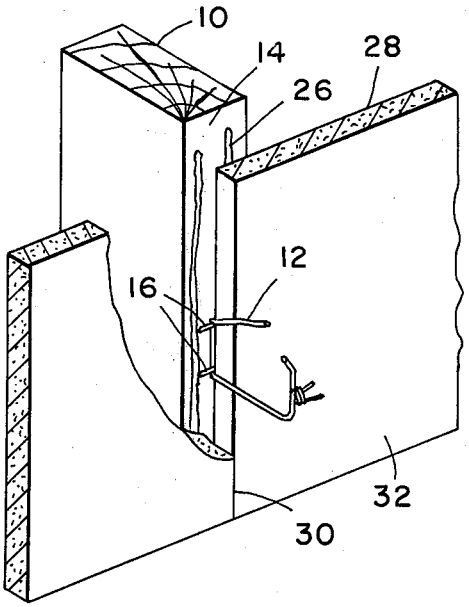
FIG. 5 is a view of the wall of FIG. 3 during removal of the temporary holding means.

Referring to the drawings, an elongate structural framing member, such as wood stud 10 has an 8 inch (20 centimeters) length of 18 gauge tie wire 12 affixed to the stud face 14 by two staples 16, 16.

Each staple 16 has the usual U-shape, with two end legs 20, 20 extending into the stud and a cross leg 22 extending along the stud face 14, holding tie wire 12. The two staples are spaced apart, one from the other, about 1 inch (2 centimeters). A 3 inch (8 centimeters) end portion 24 of tie wire 12, extends away from the stud face at each of the two staples.

The narrow, elongate beads of adhesive 26 extend along the stud face 14, one at each side. Two coplanar sheets of wallboard 28, 28 are disposed against the beads of adhesive 26, 26, forming a joint 30 generally centered over the stud face 14. The wallboards may be gypsum wallboard of about ¼ inch to ⅝ inch thickness, with a predecorated face 32, requiring adhesive application to avoid the disfigurement of nail or screw application.

The tie wire end portions 24, 24 extend through the joint 30 and are accessible after the two wallboards are disposed against the stud face 14. A block 34 is firmly tied against the edges of the wallboards 28, 28 by the end portions 24, 24. The block 34 is a short wooden block having its length parallel to and over the joint 30, and having two inwardly extending slits 36, 36 arranged so that the tie wire can engage and hold the center of the block.

Figure 4:
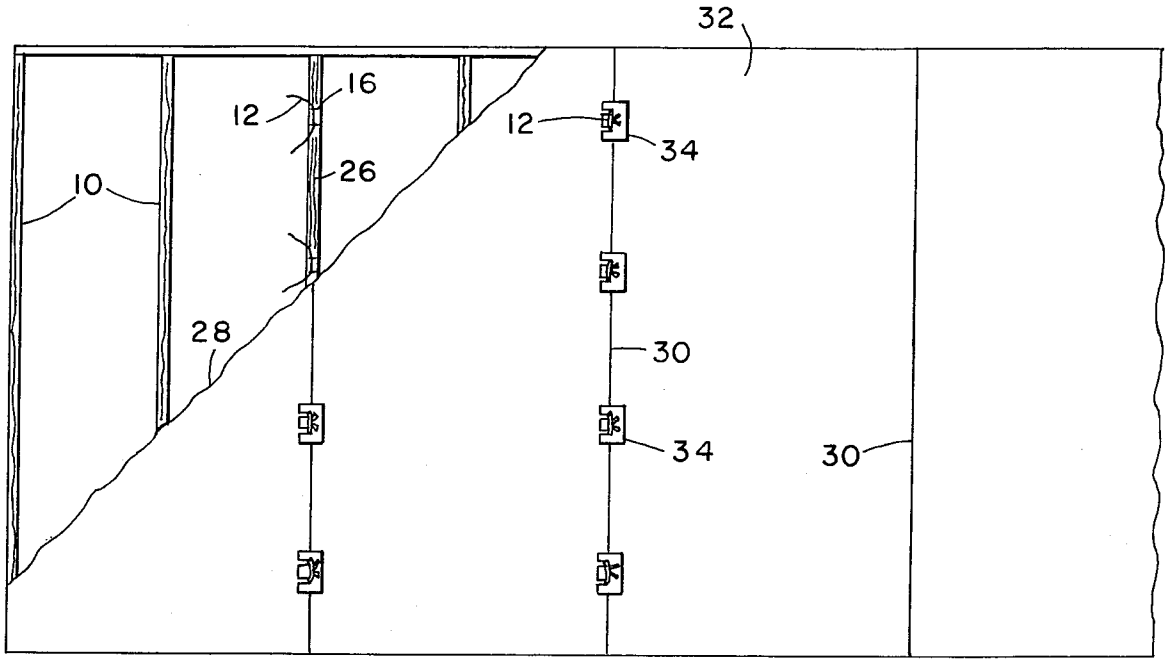
FIG. 4 is a face view of a wall having a plurality of the temporary wallboard holding means of FIG. 3.

The tie wire end portions 24, 24 are twisted together, and the twisting is made substantially as tight as can be without breaking the wire. As shown in FIG. 4, staples, wires and blocks are placed on all of the joints of a wall, at spacings of about 2 feet along each joint.

After about 1 or 2 days, depending on the kind of adhesive used, the adhesive will have developed a sufficiently strong bond, between the wallboard and the studs, that the blocks 34 and tie wires 12 can be removed. Removal of the wire consists of severing one of the two end portions 24 adjacent the block 34, and applying a pulling force to the opposite of the two end portions 24.

The pulling force applied will preferably be directed away from the opposite wire end portion and at an angle to the face of the wallboard of substantially less than 90°. Ease of removal of the wire from behind the staples can be improved, if necessary, by pulling first on the severed end of the wire, to raise slightly the staple which is adjacent that end of the wire, freeing the wire thereunder. If the severed end of the wire is bent away from the opposite wire end portion, this may reduce the bend in the wire at the staple, making wire removal still easier.

Figure 6:
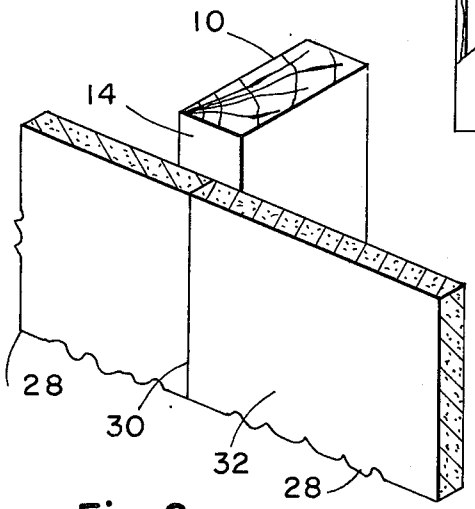
FIG. 6 is a view of the wall of FIG. 5 after removal of the temporary holding means.

After removal of the block 34 and the wire 12, a finished wall results with no apparent means showing for holding the wallboard, as shown in FIG. 6.

Although the invention is shown with a wood stud, such as a 2 × 4, sheet metal studs, of the known C-shaped cross section, may also be employed. Instead of wood blocks 34 of about 8 inch (20 centimeters) length, longer strips of wood, or other material may be used extending the full length of a joint, and engaged by a plurality of tie wires 12. In place of staples, nails could be driven part way into a stud and bent over the tie wire 12.

Having completed a detailed disclosure of the preferred embodiments of our invention, so that others may practice the same, we contemplate that variations may be made without departing from the essence of the invention.

We claim:

1. A wall construction comprising an elongate framing member and two wallboards affixed to said framing member, said wallboards being in edge abutting coplanar relationship with a joint between said wallboards disposed over said framing member, and means holding said wallboards relative to said framing member consisting essentially of a pair of spaced apart metal fasteners, fastened to the face of said framing member and disposed between said wallboards and said framing member face, a removable tie wire held against the said face of said framing member by said pair of fasteners and an elongate rigid member disposed over the said wallboard joint, said rigid member being held in place by the ends of said tie wire which extend from said fasteners through said joint and engage said rigid member, urging said wallboard edges against said framing member.

2. A wall construction as defined in claim 1 wherein said fasteners are staples.

3. A wall construction as defined in claim 1 wherein said fasteners are nails, partially driven into said framing member and bent over against the face of said framing member.

4. A wall construction as defined in claim 1 wherein said fasteners are spaced about one inch apart.

5. A wall construction as defined in claim 1 wherein an adhesive is disposed between said wallboards and said framing member.

6. A method of temporarily holding two adjacent wallboards against a framing member comprising the steps of attaching the central portion of an elongate wire to the face of said framing by a pair of spaced apart metal fasteners formed to lie closely against the framing member face, extending the two end portions of said wire outwardly from said framing member, disposing said two wallboards against said framing member to form a joint therebetween disposed over said framing member with said wires extending through said joint, tieing a rigid member against the faces of said two wallboards with said wire and holding said wallboards against said framing members for a desired period of time, severing one of said two end portions of wire, and pulling the other of said two end portions of wire to remove said wire from said pair of metal fasteners.

7. The method of claim 6 wherein adhesive is disposed between said wallboards and said framing member.

8. The method of claim 7 wherein said wire is tied tightly to hold said wallboard firmly to said framing member during a period of time during which said adhesive develops a substantially increased strength of bond.

9. The method of claim 6 wherein said fasteners are staples.

10. The method of claim 9 further comprising the steps of pulling the severed end portion of wire to raise the adjacent fastener slightly before pulling the other of said two end portions and bending said end portions to reduce the angle of the wire at each said staple to substantially less than 90°.

* * * * *